US009711074B2

(12) United States Patent
Ko et al.

(10) Patent No.: US 9,711,074 B2
(45) Date of Patent: Jul. 18, 2017

(54) APPARATUS AND METHOD FOR PREVENTING IMAGE DISPLAY DEFECTS IN A DISPLAY DEVICE

(71) Applicant: MagnaChip Semiconductor, Ltd., Chungcheongbuk-do (KR)

(72) Inventors: Jae Hong Ko, Seoul-si (KR); Shin Yoon, Seoul-si (KR); Byung Jae Nam, Seongnam-si (KR); Chang Ho Ahn, Hwaseong-si (KR); Sang Hyun Park, Seoul-si (KR)

(73) Assignee: MagnaChip Semiconductor, Ltd. (KR)

( * ) Notice: Subject to any disclaimer, the term of this patent is extended or adjusted under 35 U.S.C. 154(b) by 123 days.

(21) Appl. No.: 14/661,556

(22) Filed: Mar. 18, 2015

(65) Prior Publication Data

US 2016/0104401 A1 Apr. 14, 2016

(30) Foreign Application Priority Data

Oct. 13, 2014 (KR) ..... 10-2014-0137913

(51) Int. Cl.
*G09G 3/00* (2006.01)

(52) U.S. Cl.
CPC ..... *G09G 3/006* (2013.01); *G09G 2320/04* (2013.01); *G09G 2330/08* (2013.01)

(58) Field of Classification Search
CPC .... G06F 3/038; G09G 3/006; G09G 2330/08; G09G 2320/04
USPC ..... 345/211, 212, 213
See application file for complete search history.

(56) References Cited

U.S. PATENT DOCUMENTS 6,806,859 B1 10/2004 Kanoh et al.
2010/0231559 A1* 9/2010 Ooga ..... G09G 3/20 345/205
2011/0037758 A1* 2/2011 Lim ..... H03L 7/0805 345/213
2012/0249618 A1* 10/2012 Sugiyama ..... H04L 25/49 345/691
2013/0285998 A1* 10/2013 Hong ..... G06F 3/038 345/212
2015/0279299 A1* 10/2015 Liou ..... H04L 7/0331 345/211

* cited by examiner

*Primary Examiner* — Dmitriy Bolotin
(74) *Attorney, Agent, or Firm* — McGuireWoods LLP

(57) ABSTRACT

An apparatus and a method that quickly detect an error that may occur due to an external noise occurrence during display of image data on a screen of an image display device, and that control a strobe signal output to prevent a screen defect from being displayed on the display device screen.

16 Claims, 7 Drawing Sheets

APPARATUS AND METHOD FOR PREVENTING IMAGE DISPLAY DEFECTS IN A DISPLAY DEVICE

CROSS-REFERENCE TO RELATED APPLICATION

This application claims the benefit under 35 U.S.C. §119 of Korean Patent Application No. 10-2014-0137913, filed on Oct. 13, 2014, in the Korean Intellectual Property Office, the entire disclosure of which is incorporated herein by reference for all purposes.

BACKGROUND OF THE DISCLOSURE

1. Field of the Disclosure

The following disclosure generally relates to an image display apparatus and image display method and, more particularly, to an apparatus and method for preventing image display defects related to a noise occurrence.

2. Description of Related Art

Recently, various types of displays have become available on the market for displaying digital content. The most common displays are flat-panel type displays, such as, for example, Liquid Crystal Display (LCD) devices, Organic Light Emitting Display (OLED) devices, Light Emitting Display (LED) devices, and the like.

The vast majority of modern displays, including flat-panel type displays, include intra-panel interface technologies. Clock embedded signal technology typically includes sending both display data and clock information on a data transmission line to reproduce moving images on the displays. The clock information is associated with the data and embedded in the data signal to provide a clock embedded signal. Each pixel may be composed of three sub-pixels of Red, Green, and Blue. The data signal may include, for example, eight bits for each color data, totaling twenty-four bits for Red data, Green data, and Blue data for one pixel.

The displays typically include display driver integrated circuits (ICs) that control the display of images on the display screen by generating and supplying strobe signals (i.e. horizontal start signals) that are latched to a single horizontal line of the display screen. The display driver ICs typically include a data driver, a scan driver and a controller. The controller converts externally supplied digital display (or image) data to digital data that can be processed by the data driver; and, the controller supplies timing signals to control the data driver and scan driver to display the display data, including, among other things, strobe signals and a clock signals. The strobe signals are provided differently based on the resolution of the particular display device. In the case of a display device having a 1920×1080 resolution, the strobe signal is enabled 1080 times during a single image frame.

FIG. 1 shows an example of a driver timing chart for a single image frame. As seen in FIG. 1, the strobe signal is enabled for each scan line of the display (e.g., 1080 times for a single image frame) to scan all lines of the image frame. The strobe signal is generated automatically at a designated time, as seen in FIG. 1. The display driver IC includes a counter (not shown) that continuously counts and outputs an internal clock signal during the image display driving period, so that when all clock cycles of the internal clock signal configured to generate one scan line are completed, a strobe signal is automatically generated. This is the structure currently employed in most display driver ICs.

In FIG. 1, waveform A is a display data (or information) signal, waveform B is a strobe signal, and waveform C is a panel drive signal. Additionally, HBP stands for Horizontal Blanking Packet, which corresponds to the horizontal blanking section. The layout of a frame can be altered through the blanking section (or interval).

However, display driver ICs, like that described above, are susceptible to displaying erroneous data signals due to noise occurrences, such as, for example external noise occurrences. As discussed above, the display driver ICs generate strobe signals continuously in accordance with the horizontal line scan period, generating a strobe signal for every scan line in an image frame.

FIG. 2 shows an example where an external noise signal (e.g., electrostatic signal) is applied at point a, affecting the display driver IC. Referring to FIG. 2, after latching data of one scan line, a strobe signal is generated at point b even though the external noise signal was applied at point a. Since the noise signal occurred during data latch, an abnormal state is indicated and the clock signal and display data cannot be properly processed by the display driver IC. Thus, the display driver IC experiences a display defect, outputting the wrong display data during idle time until the clock signal and display data are restored to the normal state.

FIG. 3 illustrates an example of a display defect that is displayed on the screen of an image display device as an erroneous image on a horizontal line(s). Although FIG. 3 shows a single line defect, it is noted that most modern displays will generally produce defects across, for example, 3-5 scan lines of screen.

SUMMARY OF THE DISCLOSURE

This summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

In an effort to solve the problem of abnormal screen displays due to noise occurrences, the present disclosure provides an apparatus and a method for preventing an abnormal screen (or screen defect) in an image display device. The apparatus and method comprise preventing a strobe (ST) signal from being generated when a noise occurrence is detected while the display driver IC is driven in the image display device.

Another object of the present disclosure is to provide an apparatus and a method for preventing an abnormal screen display in an image display device by maintaining display data from a scan line prior to a noise occurrence point and displaying the display data during the scan line with the noise occurrence. The apparatus and method include detecting a noise occurrence while the display driver IC is driven in the image display device and masking a strobe signal.

According to an aspect of the disclosure, the apparatus for preventing an abnormal screen display comprises a separator that separates a clock signal and a display data (or information) signal from a clock embedded signal; a first latch that latches the data signal; a lock detector that outputs a lock signal having a predetermined level after comparing an Nth clock waveform and N−1th clock waveform of the clock signal; a control logic unit that selectively outputs a strobe signal based on the lock signal level; a second latch that latches the data signal that is latched in the first latch based on the strobe signal; and an output section that outputs the data signal latched in the second latch as a panel driver signal. A clock waveform may comprise one clock cycle, or a group of clock cycles. The separated display data signal may include a real-time display data signal.

The predetermined level of the lock signal may include a high level or a low level based on the clock signal. The lock signal may include the low level when noise is included in the data signal that is latched on the first latch.

The lock detector may output a low level lock signal if a phase of the Nth clock waveform and the N−1th clock waveform of the clock signal do not conform to a predetermined condition.

The control logic unit may be configured not to (or prevent) output of the strobe signal when the lock signal comprises a low level.

The output section may be configured to output a data signal for a prior scan line to be displayed for a current scan line when the strobe signal is not output.

The lock detector may comprise: a first element, which may be provided with the Nth clock waveform and a −1 unit interval (UI) fast clock waveform of the internal clock signal; a second element, which may be provided with the Nth clock waveform and a +1 UI slow clock waveform of the internal clock signal; and, a logic element that may output a lock signal having a high level when the first and second elements output a value that is greater than +1 UI or smaller than −1 UI.

The first element and the second element may each comprise a DQ flip-flop. The logic element may comprise an AND gate.

According to an aspect of the disclosure, an apparatus configured to prevent an abnormal screen display may comprise: a detector that is configured to detect a noise occurrence during driving of the image display device; and, a display driver IC that is configured not to output, or to prevent the output of a strobe signal for one or more scan lines when a noise occurrence is detected in the scan line(s).

The detector may detect the noise occurrence by comparing a current clock-waveform and a prior clock waveform of a recovered clock signal. The detector may output a lock signal having a predetermined level that is based on the comparison.

The predetermined level of the lock signal may be maintained at a low level while the display driver IC does not output the strobe signal.

According to a further aspect of the disclosure, a method is provided for preventing an abnormal screen display. The method comprises: separating a data signal and a clock signal from an clock embedded signal; latching the data signal every scan line based on a strobe signal; detecting a noise occurrence based on the clock signal; and, outputting the strobe signal based on the clock signal, wherein the strobe signal is prevented from being output when the noise occurrence is detected.

The step of detecting the noise occurrence may comprise comparing a successively applied Nth clock waveform and a N−1th clock waveform of the clock signal.

The strobe signal may be prevented from being output when the Nth clock waveform and the N−1th clock waveform are outside of a predetermined range.

The method may further comprise outputting a lock signal having a predetermined level, wherein the predetermined level comprises a low level when the noise occurrence is detected.

The predetermined level may transition to a high level when the Nth clock waveform and the N−1th clock waveform of the clock signal are within a predetermined range.

The step of latching the data signal every scan line may comprise maintaining the data signal from a scan line prior to the noise occurrence until the strobe signal is received again.

When the noise occurrence is detected, the predetermined level of the lock signal may shift from a high level to a low level.

The low level lock signal may shift to the high level when the Nth clock-waveform and the N−1th clock waveform are within a predetermined range.

The apparatus and method of the present disclosure quickly detect a noise occurrence and control the output of a strobe signal in accordance with the result of the noise detection when the noise is applied during driving of an image display device that employs a clock embedded interface and latches display data based on the strobe signal.

The apparatus and method according to the present disclosure eliminate screen defects by displaying data from a prior, error free scan line(s) in place of data containing noise. As a result, the apparatus and method described herein are expected to solve users' dissatisfaction with image display devices that display screen defects due to noise occurrences, potentially resulting in product recalls or repairs.

BRIEF DESCRIPTION OF THE DRAWINGS

The accompanying drawings, which are included to provide a further understanding of the disclosure, are incorporated in and constitute a part of this specification, illustrate embodiments of the disclosure and together with the detailed description serve to explain the principles of the disclosure. No attempt is made to show structural details of the disclosure in more detail than may be necessary for a fundamental understanding of the disclosure and the various ways in which it may be practiced. In the drawings.

Figure 1:
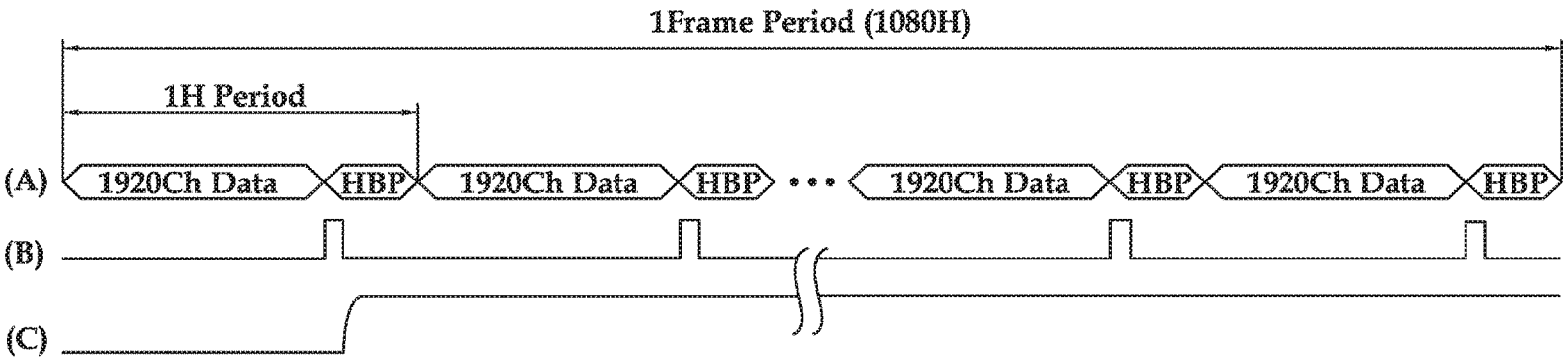
FIG. 1 illustrates an example of a driver timing diagram for a single image frame in an image display device.
Figure 2:
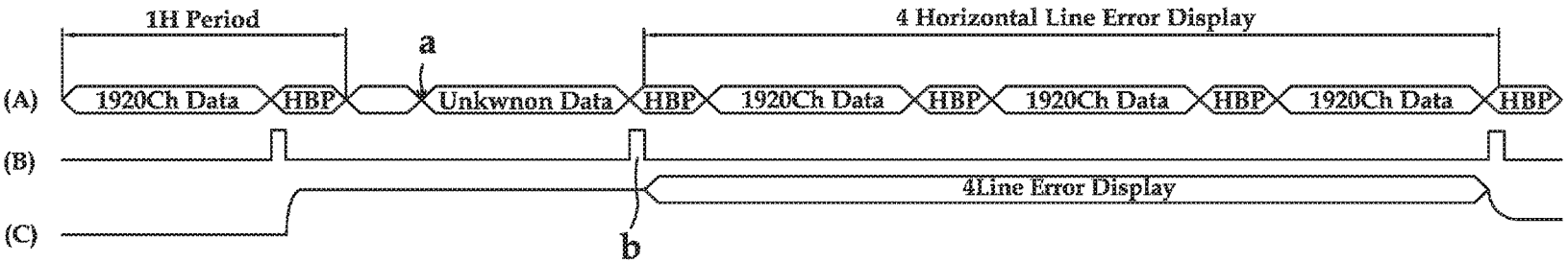
FIG. 2 illustrates an example of a driver timing diagram with a screen defect resulting from an external noise occurrence in the image display device of FIG. 1.

The present disclosure is further described in the detailed description that follows.

DETAILED DESCRIPTION

The following detailed description is provided to assist the reader in gaining a comprehensive understanding of the methods, apparatuses, and/or systems described herein. The disclosure and the various features and advantageous details thereof are explained more fully with reference to the non-limiting embodiments and examples that are described and/or illustrated in the accompanying drawings and detailed in the following description. It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments of the disclosure. The examples used herein are intended merely to facilitate an understanding of ways in which the disclosure may be practiced and to further enable those of skill in the art to practice the embodiments of the disclosure. Accordingly, the examples and embodiments herein should not be construed as limiting the scope of the disclosure. Various changes, modifications, and equivalents of the systems, apparatuses and/or methods described herein will be apparent to one of ordinary skill in the art. Moreover, it is noted that like reference numerals represent similar parts throughout the several views of the drawings.

The present disclosure is characterized by an image display device equipped with a display driver IC that provides a method to extract a clock signal and a display data signal using a clock embedded interface. The image display device may include a DLL (Delay Lock Loop) or PLL (Phase Lock Loop) to recover the embedded clock signal information from the data signal. According to an aspect of the disclosure, the image display device detects an external noise occurrence in real-time and prevents a strobe signal output, thereby maintaining prior data and removing a screen defect phenomena that would otherwise result in display of noise on a screen scan line.

An embodiment of an apparatus and a method for preventing an abnormal screen (or screen defect) in an image display device according to the present disclosure is described in detail below, with references of the drawings.

Figure 4:
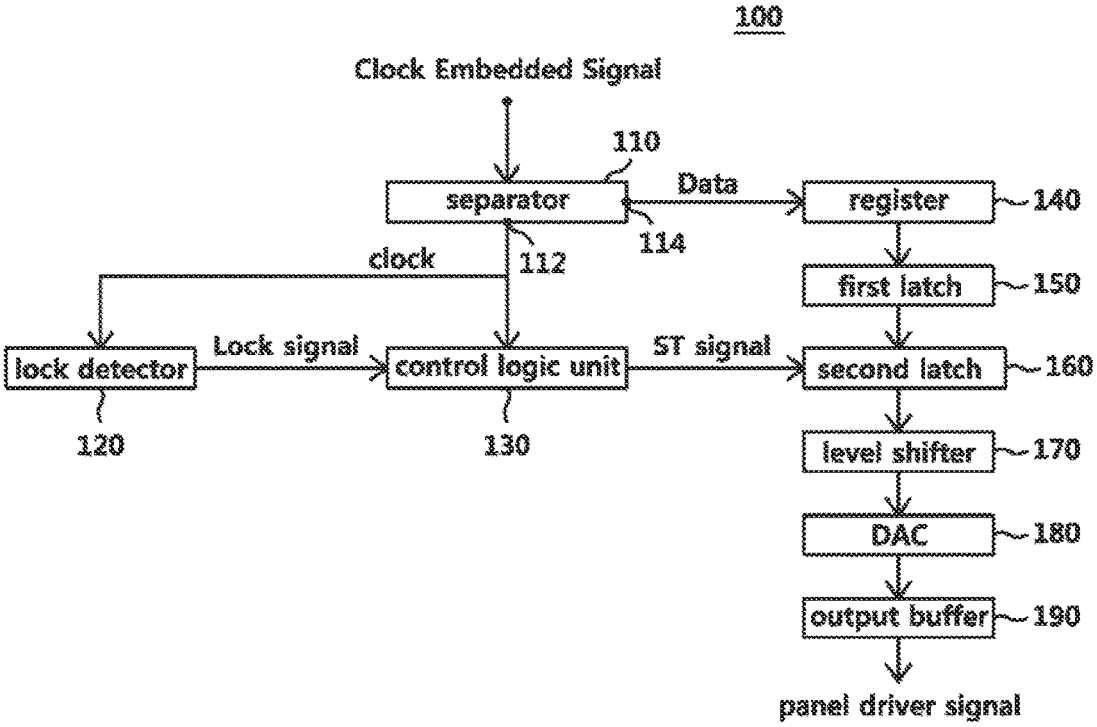
FIG. 4 is a block diagram of an apparatus for preventing a screen defect in an image display device according to an embodiment of the disclosure.

FIG. 4 is a block diagram of an apparatus 100 for preventing display of a screen defect in an image display device, according to the disclosure.

Referring to FIG. 4, the abnormal screen prevention apparatus 100 comprises a separator 110, a lock detector 120, a control logic unit 130, a register 140, a first latch 150, a second latch 160, a level shifter 170, a digital to analog converter (DAC) 180 and an output buffer 190. The DAC 180 and/or output buffer 190 may comprise an output section. The output section may further comprise the second latch 160 and/or level shifter 170.

The separator 110 receives a clock embedded signal at an input terminal and separates the received clock embedded signal into a clock signal and a display data (or information) signal. The display data signal may be a real-time display data signal. The clock embedded signal includes clock information associated with the display data. For example, the clock embedded signal may include a signaling scheme that transmits clock information by embedding the clock information in a data stream, using, for example, coding of a predetermined bit or adjusting the voltage level of the clock embedded signal, as is known to those skilled in the art. The separator 110 comprises, in addition to the input terminal, a pair of output terminals 112, 114. The output terminals 112, 114 output the clock signal and the data signal, respectively.

The separator 110 may comprise a delay lock loop (DLL) or a phase look loop (PLL) (not shown) to extract the embedded clock information from the received data signal and output the recovered clock signal and the display data signal.

The lock detector 120 and control logic unit 130 are connected to the clock output terminal 112. The lock detector 120 receives the clock signal from the separator 110 and outputs a lock signal at an output terminal that has a level (e.g., a high or a low level) as described below. The lock signal is supplied to an input terminal of the control logic unit 130. The level of the lock signal changes when a noise occurrence is detected.

Figure 5:
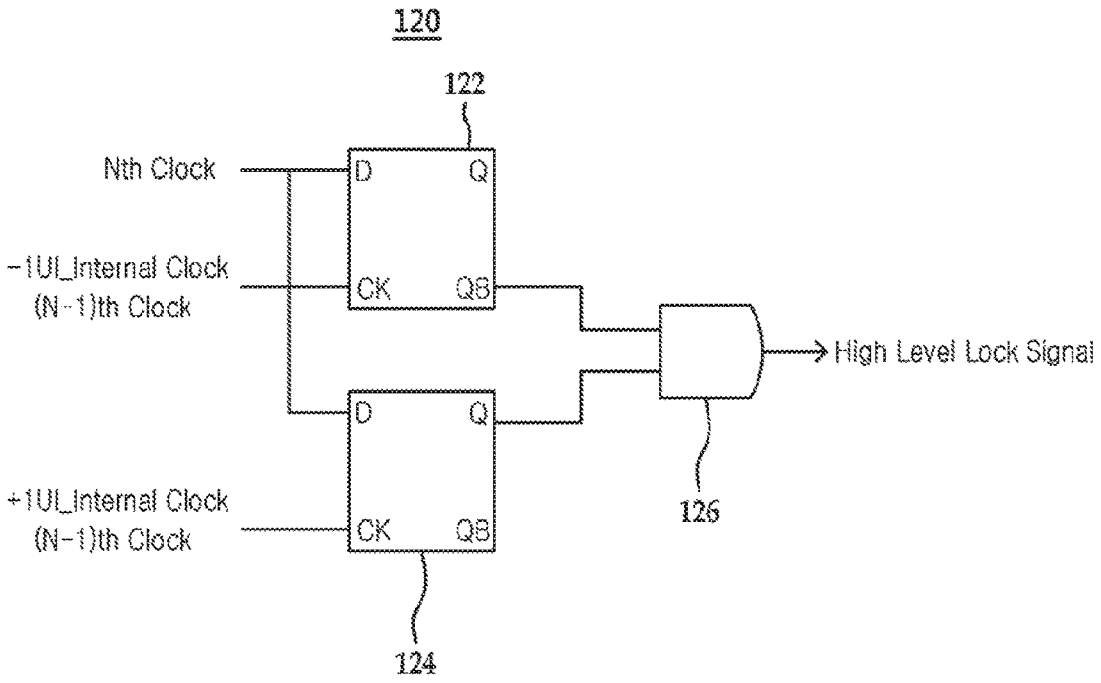
FIG. 5 is an example of a lock detector that may be included in the apparatus of FIG. 4.

FIG. 5 shows an example of a lock detector that may be used in the lock detector 120 of the apparatus 100 (shown in FIG. 4). The lock detector 120 may include a pair of flip-flops 122, 124 and a logic element 126, as described in greater detail below.

Referring back to FIG. 4, the control logic unit 130 may be configured to output a strobe (ST) signal according to the lock signal received at its input terminal from the output terminal of the lock detector 120. For instance, the control logic unit 130 may be configured to output an ST signal after receiving the last clock cycle of the clock signal while the lock signal is at a high voltage level.

The output terminal 114 of the separator 110 is connected to an input terminal of the register 140, which is a memory device. The data signal, which is to be displayed on the screen, is received from the separator 100 at the input terminal and stored in the register 140. While FIG. 4 shows a single register 140, one of ordinary skill in the art will understand that a plurality of registers may be connected according to the resolution of the image display device. For example, an image display device having 1920×1080 resolution may have a total of 1,920 registers 140 (or 3×1920=5760 registers for R, G, B) connected in parallel to the output(s) 114 of the separator 110.

The first latch 150, which latches data stored in the register 140, is connected to the output terminal of the register 140. The number of first latches 150 included in the apparatus 100 may correspond to the number of registers 140. Hence, in the above example, the apparatus 100 may include 1,920 first latches 150 (or 5760 latches for R, G, B). The first latch 150 latches data in accordance with every cycle of the clock signal while sharing a bus line.

The register 140 and the first latch 150 are provided with real-time data from the separator 110 and store/latch the received data.

An input terminal of the second latch 160 is connected to an output terminal of the first latch 150. The second latch 160 receives and stores data from the first latch 150 in accordance with the strobe (ST) signal output from the control logic unit 130. Data stored in the second latch 160 becomes data which is displayed on the display screen.

In the event of an external noise occurrence, display data (or "abnormal data") that includes a noise signal may be stored in the first latch 150 and display data without the noise signal may be stored in the second latch 160. If the abnormal data is received and stored in the second latch 160, the abnormal data may cause a screen defect to be displayed. According to the present disclosure, however, the ST signal is generated so as not to store the abnormal data in the second latch 160.

An input of the level shifter 170 is connected to an output of the second latch 160. The level shifter 170 shifts an output level of the control logic unit 130, causing the control logic unit 130 to shift between a lower voltage output level and a higher voltage output level. For instance, the output level of the control logic unit 130 may be shifted from a lower voltage output of, for example, about 1.8 V to a higher voltage output of, for example, about 18 V.

An input terminal of the digital-to-analog converter (DAC) 180 is connected to an output terminal of the level shifter 170; and, an input terminal of the output buffer 190 is connected to an output terminal of the DAC 180. The DAC 180 receives the data signal from the level shifter 170, converts the digital signal to an analog signal and outputs the analog signal to the output buffer 180. The panel driver signal is outputted via the output buffer 190.

FIG. 5 shows a block diagram of an example of a lock detector which may be included in the lock detector 120 illustrated in FIG. 4.

In the example in FIG. 5, the lock detector 120 comprises two flip-flop elements 122, 124 and a logic element 126. In this example, the flip-flop elements include a DQ flip-flop element, but other flip-flop elements, which can monitor the Nth clock signal's phase difference by using N−1th clock signal, can also be employed ("N" is a positive integer greater than one). The logic element may comprise, for example, an AND gate.

Referring to FIG. 5, the first element 122 outputs a result (a QB signal) after receiving the Nth clock waveform of the recovered clock signal at the D input terminal and a −1UI fast clock of the internal clock signal [−1UI_Internal Clock of the (N−1)th Clock] at the clock (CK) input terminal. The clock waveform may include one clock cycle, or a group of clock cycles.

The second element 124 outputs a result (a Q signal) after receiving the Nth clock waveform of the recovered clock signal at the D input terminal and a +1 UI slow clock of the internal clock [+1 UI_Internal Clock of the (N−1)th Clock] at the clock (CK) input terminal.

The logic element 126 receives the respective output values, QB signal and Q signal, from the first element 122 and second element 124 and, when a predetermined condition is fulfilled, the logic element 126 outputs a high level clock signal. In the example illustrated in FIG. 5, the logic element is an AND gate that outputs a high level lock signal when both the QB signal Q signal are a high level. In other words, the AND gate outputs a lock signal in high level when the output values QB and Q, respectively, from the flip-flops 122, 124 fulfill the predetermined condition: "−UI clock<output value<+UI clock." That is, the AND gate may monitor a current clock value using a prior clock value, so that when there is a phase difference in the current clock value of more than ±1 UI phase difference compared to the prior clock value, the AND gate will output a low level lock signal, as data cannot be processed normally.

Figure 6:
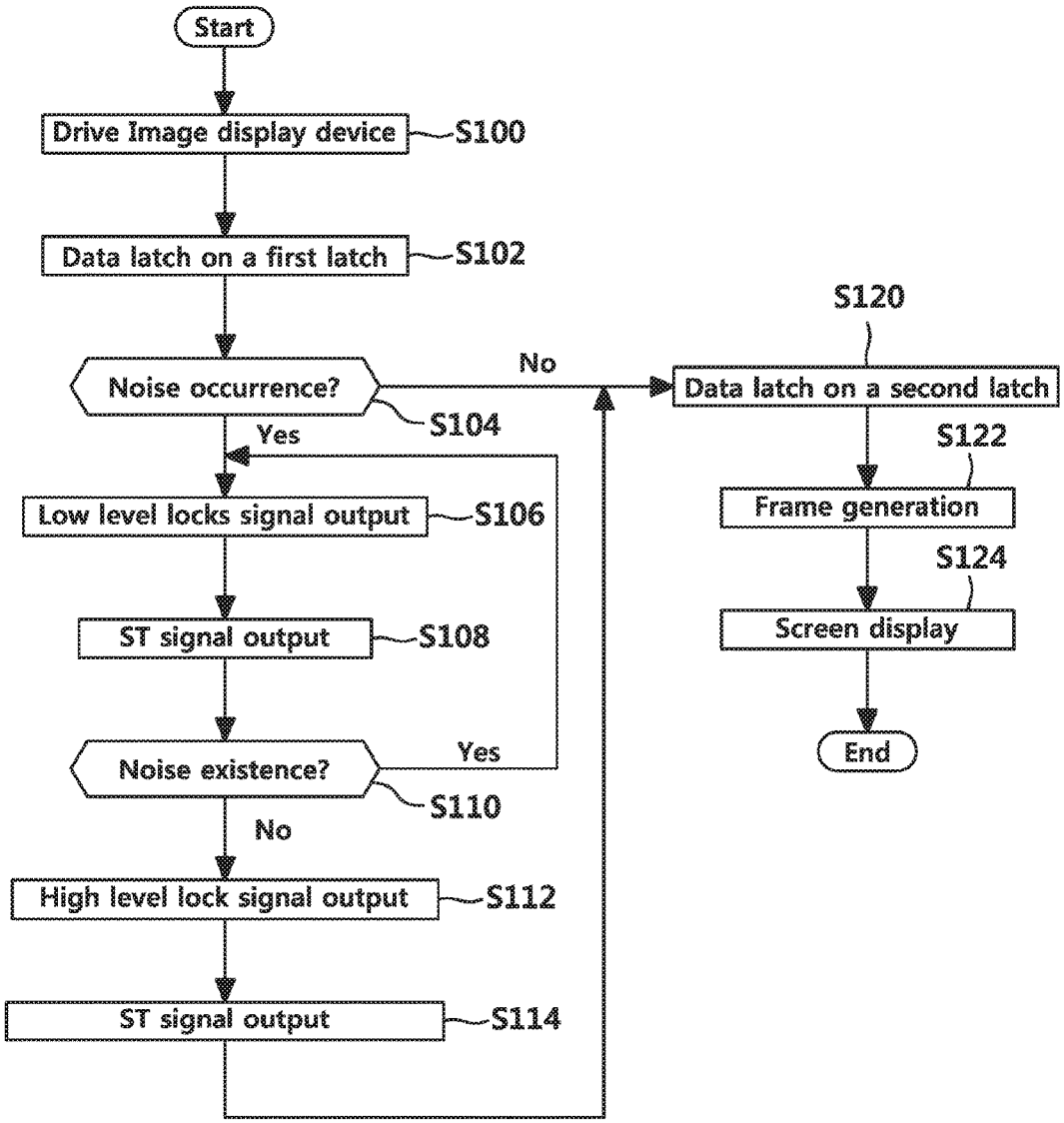
FIG. 6 is a flow chart that depicts a method for preventing a screen defect in an image display device according to the embodiment of the disclosure.
Figure 7:
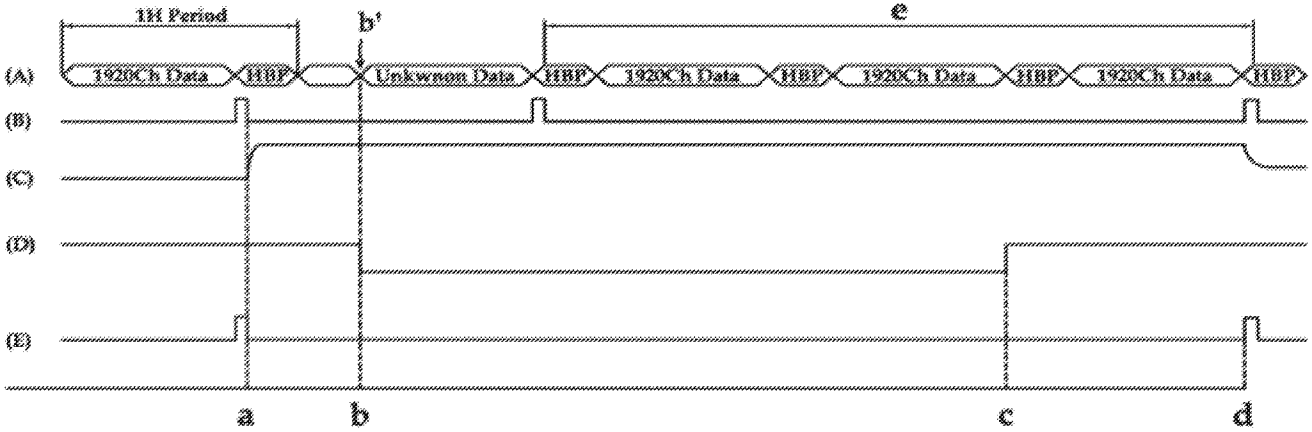
FIG. 7 is a timing chart illustrating an application of the method for preventing a screen defect.
Figure 8:
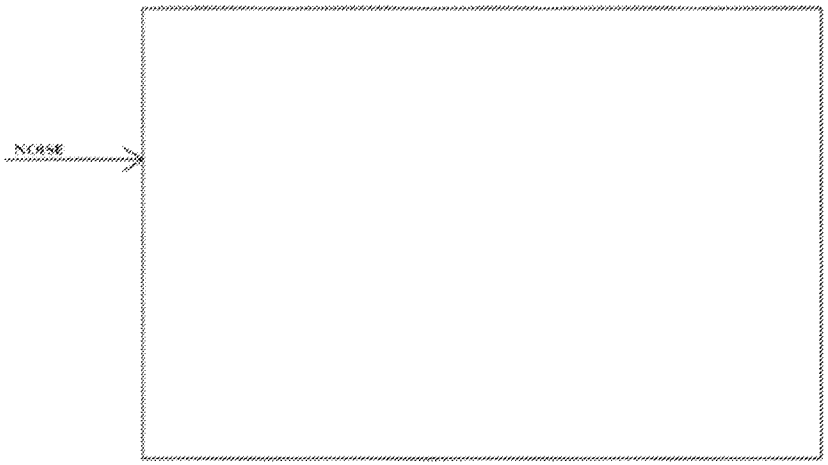
FIG. 8 is a block diagram showing an example of a screen display according to the embodiment of the present disclosure.

FIGS. 6 to 8 illustrate a method and effects of employing the apparatus 100 to prevent abnormal screen display in an image display device, where the image display device is exposed to, for example, an external noise occurrence during image display. As disclosed herein, during data latch, while displaying image data on a screen, the apparatus 100 is configured not to output a strobe signal for the scan line(s) containing the noise signal.

FIG. 6 shows a flow chart that depicts an example of a method for preventing an abnormal screen display in an image display device, according to the principles of the disclosure.

Referring to FIGS. 4 and 6, the method may begin when an image display device is driven (S100) and the separator 110 separates a clock signal and a display data signal from a clock embedded signal to display image data on the screen of the image display device. The separated display data signal may be received and latched in the first latch 150 (S102) after passing through the register 140. In the case of an image display device having 1920×1080 resolution, the display data may be latched in the first latch 150 consecutively from a first scan line to the 1080th scan line.

The separated clock signal is supplied to the lock detector 120, where a detection is made regarding a noise occurrence (S104). If the lock detector 120 detects a noise occurrence by continuously monitoring a prior and a current clock value while the data is latched in the first latch 150, then the lock detector outputs a low level lock signal to the control logic unit 130 (YES at S104, then S106).

In the case of no noise occurrence (NO at S104), data latched in the first latch 150 is output to and latched in the second latch 160 (S120) according to the strobe signal from the control logic unit 130. Then, a frame may be generated (S122) and displayed on the screen of the image display device (S124).

On the other hand, when noise is detected (YES at S104), the lock detector 120 determines that the display data cannot be normally processed. For example, referring to FIG. 5, at least one output value of the first element 122 and the second element 124 is out of the range "−UI clock<output value<+UI clock," and the AND gate 126 outputs a lock signal as a low level signal (S106).

When the lock signal is a low level signal (S106), the control logic unit 130 controls not to output the strobe signal (S108). If the strobe signal is not output by the control logic unit 130, then data latched in the first latch 150 cannot be latched in the second latch 160. In that instance, the second latch 160 maintains the stored prior display data.

The lock detector 120 continuously monitors whether the condition "−UI clock<output value<+UI clock" is fulfilled (S110). As a result, if the condition is fulfilled (YES at S110), then the lock detector 120 determines that display data can be processed normally and outputs a lock signal having a high level to the control logic unit 130 (S112).

Figure 3:
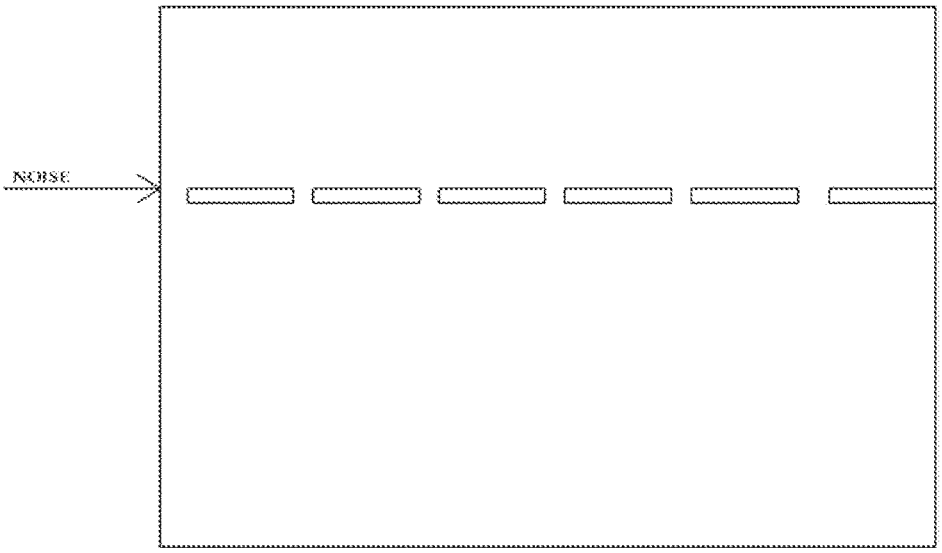
FIG. 3 is a block diagram of the screen defect state displayed by the image display device of FIG. 1.

After receiving the high level lock signal, the control logic unit 130 outputs a strobe signal to the second latch 160 and the display data is latched from the predetermined scan line in the second latch 160. In other words, when a noise occurrence is detected, the control logic unit 130 is controlled not to output a strobe signal for a scan line that may include the noise occurrence and, subsequently, and to cause the display data from the previous line to be displayed. Thereby, noise inputted in a scan line will not be displayed, but, instead, the prior scan line will be displayed on the screen, which does not include the noise as shown in FIG. 8. In other words, as seen in FIG. 8, the screen defect which was shown in FIG. 3 is eliminated.

The above method of preventing display of an abnormal screen can be recited again, referring to the time chart shown in FIG. 7.

FIG. 7 is a timing chart showing an effect of the abnormal screen prevention method (shown in FIG. 6), according to the principles of the disclosure. In FIG. 7, waveform (A) is a data signal, waveform (B) is an ST signal without the benefit of the instant disclosure, waveform (C) is a panel driver signal, waveform (D) is a lock signal, and waveform (E) is an ST signal according to the present disclosure.

Referring to FIG. 7, when display data (e.g., 1920Ch Data) A is latched for a single horizontal (1H) time period (1H Period), the panel driver signal (C) becomes high level at point a, to display image data on the image display device screen, and the lock signal (D) maintains a high level.

Assuming that a noise occurrence happens at point b', then the lock detector 120 (shown in FIG. 4, which may include the AND gate 126 shown in FIG. 5) will detect the noise occurrence and output a lock signal (D) having a low level at point b. The low level lock signal is provided to the control logic unit 130, which is configured not to output a strobe (ST) signal (E) during a low level lock signal. Referring to waveform (B) in FIG. 7, which illustrates ST signal generation without the benefit of the instant disclosure, a strobe signal will be output after the point b' of noise occurrence. However, with the benefit of the present disclosure, a strobe signal will not be output after noise occurrence as seen in waveform (E), until the lock signal (D) from the lock detector 120 transitions from a low level to a high level.

Afterwards, after point c, the lock detector 120 may output a lock signal having a high level again. The control logic unit 130, receiving the high level lock signal, will output a strobe signal at point d.

Therefore, an image display device may be prevented from displaying a screen defect during the e period (or section), instead displaying the prior image data for the scan line(s).

As noted earlier, the disclosure provides an image display device that employs a clock embedded interface and a method to extract clock and display data using, for example, a DLL (Delay Lock Loop), a PLL (Phase Lock Loop), or the like. Thus, the display driver IC may detect a noise occurrence when noise occurs during data screen display and control to mask (or not output) a strobe signal, thereby preventing display of the corresponding noise signal on the screen of the image display device.

The terms "including," "comprising," "having," and variations thereof, as used in this disclosure, mean "including, but not limited to," unless expressly specified otherwise.

The terms "a," "an," and "the," as used in this disclosure, means "one or more", unless expressly specified otherwise.

Devices that are in communication with each other need not be in continuous communication with each other, unless expressly specified otherwise. In addition, devices that are in communication with each other may communicate directly or indirectly through one or more intermediaries.

Although process steps, method steps, algorithms, or the like, may be described in a sequential order, such processes, methods and algorithms may be configured to work in alternate orders. In other words, any sequence or order of steps that may be described does not necessarily indicate a requirement that the steps be performed in that order. The steps of the processes, methods or algorithms described herein may be performed in any order practical. Further, some steps may be performed simultaneously.

When a single device or article is described herein, it will be readily apparent that more than one device or article may be used in place of a single device or article. Similarly, where more than one device or article is described herein, it will be readily apparent that a single device or article may be used in place of the more than one device or article. The functionality or the features of a device may be alternatively embodied by one or more other devices which are not explicitly described as having such functionality or features.

While this disclosure includes specific examples, it will be apparent to one of ordinary skill in the art that various changes in form and details may be made in these examples without departing from the spirit or scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. An apparatus for preventing an abnormal screen display, comprising:

a separator configured to separate a clock signal and a data signal from a clock embedded signal;

a first latch that latches the data signal;

a lock detector that receives the clock signal and outputs a lock signal at a predetermined level after comparing an Nth clock waveform and an N−1th clock waveform of the clock signal;

a control logic unit that selectively outputs a strobe signal based on the predetermined level of the lock signal;

a second latch that latches the data signal that is latched in the first latch based on the strobe signal; and, an output section that outputs the data latched in the second latch as a panel driver signal.

2. The apparatus of claim 1, wherein the predetermined level of the lock signal comprises a high level or a low level, and, wherein the predetermined level comprises a low level when noise is included in the data signal that is latched in the first latch.

3. The apparatus of claim 1, wherein the lock detector is configured to output a low level lock signal when a phase of the Nth clock waveform and the N−1th clock waveform do not conform with a predetermined condition.

4. The apparatus of claim 1, wherein the control logic unit is configured to not output a strobe signal when the predetermined level of the lock signal is a low level.

5. The apparatus of claim 4, wherein the second latch is configured to output data of a prior scan line based when the strobe signal is not output.

6. The apparatus of claim 1, wherein the lock detector comprises:

a first element that receives the Nth clock waveform and a −1UI fast clock of the N−1th clock waveform;

a second element that receives the N−1th clock waveform and a +UI clock of the N−1 the clock waveform; and, a logic element that outputs a high level lock signal when a first element output value and a second element output value are larger than +1UI or smaller than −1UI.

7. The apparatus of claim 6, wherein the first element and the second element comprise a DQ flip-flop and the logic element comprises an AND gate.

8. An apparatus for preventing an abnormal screen display, comprising:

a noise signal detector that detects a noise occurrence during driving of an image display device; and, a display driver IC that does not output a strobe signal for a scan line that includes the noise occurrence.

9. The apparatus of claim 8, wherein the detector is configured to compare a current clock signal and prior a clock signal to detect the noise occurrence.

10. The apparatus of claim 8, wherein the noise signal detector outputs a lock signal having a predetermined level, and wherein the predetermined level comprises a low level when the display driver IC does not output the strobe signal.

11. A method for preventing display of an abnormal screen, the method comprising:

separating a data signal and a clock signal from a clock embedded signal;

latching the data signal every scan line based on a strobe signal;

detecting a noise occurrence based on the clock signal; and, outputting the strobe signal based on the clock signal, wherein the strobe signal is prevented from being output when the noise occurrence is detected.

12. The method of claim 11, wherein the detecting the noise occurrence comprises comparing a successively applied Nth clock waveform and a N−1th clock waveform of the clock signal.

13. The method of claim 12, wherein the strobe signal is prevented from being output when the Nth clock waveform and the N−1th clock waveform are outside of a predetermined range.

14. The method of claim 12, further comprising:

outputting a lock signal having a predetermined level, wherein the predetermined level comprises a low level when the noise occurrence is detected.

15. The method of claim 14, wherein the predetermined level transitions to a high level when the Nth clock waveform and the N−1th clock waveform of the clock signal are within a predetermined range.

16. The method of claim 14, wherein said latching the data signal every scan line comprises maintaining the data signal from a scan line prior to the noise occurrence until the strobe signal is received again.

* * * * *